US008783185B2

(12) United States Patent
Jacobsen et al.

(10) Patent No.: US 8,783,185 B2
(45) Date of Patent: Jul. 22, 2014

(54) LIQUID MISSILE PROJECTILE FOR BEING LAUNCHED FROM A LAUNCHING DEVICE

(75) Inventors: Stephen C. Jacobsen, Salt Lake City, UT (US); Fraser M. Smith, Salt Lake City, UT (US)

(73) Assignee: Raytheon Company, Waltham, MA (US)

( * ) Notice: Subject to any disclaimer, the term of this patent is extended or adjusted under 35 U.S.C. 154(b) by 149 days.

(21) Appl. No.: 12/814,434

(22) Filed: Jun. 11, 2010

(65) Prior Publication Data

US 2012/0216697 A1 Aug. 30, 2012

Related U.S. Application Data

(60) Provisional application No. 61/186,307, filed on Jun. 11, 2009.

(51) Int. Cl.
*F42B 5/24* (2006.01)

(52) U.S. Cl.
USPC ..... 102/501; 102/502; 102/513

(58) Field of Classification Search
USPC ..... 102/501–529
See application file for complete search history.

(56) References Cited

U.S. PATENT DOCUMENTS

| | | | | |
|---|---|---|---|---|
| 3,823,847 | A | 7/1974 | Ware | |
| 3,926,696 | A * | 12/1975 | Klunsch et al. | 149/2 |
| 4,058,256 | A | 11/1977 | Hobson et al. | |
| 4,096,326 | A | 6/1978 | Reid | |
| 4,132,658 | A | 1/1979 | Coleman et al. | |
| 4,169,818 | A | 10/1979 | DeMartino | |
| 4,172,055 | A | 10/1979 | DeMartino | |
| 4,197,800 | A * | 4/1980 | Greever et al. | 102/517 |
| 4,231,283 | A | 11/1980 | Malburg | |
| 4,241,660 | A * | 12/1980 | Donovan | 102/473 |
| 4,245,556 | A * | 1/1981 | Donovan | 102/490 |
| 4,263,927 | A * | 4/1981 | Wilski et al. | 137/13 |
| 4,297,948 | A * | 11/1981 | Donovan | 102/473 |
| 4,304,614 | A * | 12/1981 | Walker et al. | 149/46 |
| 4,313,765 | A | 2/1982 | Baird et al. | |
| 4,376,466 | A | 3/1983 | Hara | |
| 4,378,049 | A | 3/1983 | Hsu et al. | |
| 4,524,003 | A | 6/1985 | Borchardt | |
| 4,553,601 | A | 11/1985 | Almond et al. | |
| H161 | H | 11/1986 | Sullivan, Jr. | |

(Continued)

FOREIGN PATENT DOCUMENTS

| | | |
|---|---|---|
| DE | 3439796 | 11/1983 |
| DE | 10358816 | 7/2005 |

(Continued)

OTHER PUBLICATIONS

Noveon, Inc.; Carbopol ® Polymeric Rheology Modifiers; 2001; Power Point.

(Continued)

*Primary Examiner* — Samir Abdosh
(74) *Attorney, Agent, or Firm* — Thorpe North & Western LLP

(57) ABSTRACT

A liquid missile for being projected from a launching device which includes a liquid charge combined with a non-rigid flight integrity component. The flight integrity component allows the liquid charge to be launched at increased speeds and distances by inhibiting substantial break-up of the liquid charge during flight.

19 Claims, 5 Drawing Sheets

(56) References Cited

U.S. PATENT DOCUMENTS

| | | | | | |
|---|---|---|---|---|---|
| 4,627,494 | A | | 12/1986 | Kalfoglou | |
| 4,630,540 | A | | 12/1986 | Trocino | |
| 4,679,645 | A | | 7/1987 | Galloway et al. | |
| H363 | H | | 11/1987 | Duvdevani et al. | |
| 4,715,261 | A | | 12/1987 | Goldstein et al. | |
| 4,881,601 | A | | 11/1989 | Smith | |
| 5,035,183 | A | | 7/1991 | Luxton | |
| 5,076,361 | A | | 12/1991 | Naae et al. | |
| 5,100,567 | A | | 3/1992 | Naae et al. | |
| 5,284,106 | A | | 2/1994 | Meng | |
| 5,425,504 | A | | 6/1995 | Patterson | |
| H1457 | H | | 7/1995 | Sullivan, Jr. | |
| 5,505,266 | A | | 4/1996 | Fujiki | |
| 5,507,350 | A | | 4/1996 | Primlani | |
| 5,553,779 | A | | 9/1996 | Fuller et al. | |
| 5,603,454 | A | | 2/1997 | Knapp et al. | |
| 5,690,867 | A | * | 11/1997 | Nouguez et al. | 264/3.1 |
| 5,778,984 | A | | 7/1998 | Suwa | |
| 5,841,061 | A | | 11/1998 | Westfall et al. | |
| 6,012,531 | A | | 1/2000 | Ryan | |
| 6,220,141 | B1 | | 4/2001 | Fitter et al. | |
| 6,439,216 | B1 | | 8/2002 | Johnson et al. | |
| 6,474,564 | B2 | | 11/2002 | Doshay et al. | |
| 6,533,191 | B1 | | 3/2003 | Berger et al. | |
| 6,725,941 | B2 | | 4/2004 | Edwards et al. | |
| 6,796,382 | B2 | | 9/2004 | Kaimart | |
| 6,860,187 | B2 | | 3/2005 | O'Dwyer | |
| 6,896,204 | B1 | | 5/2005 | Greene et al. | |
| 6,906,010 | B2 | | 6/2005 | Hoy | |
| 6,912,958 | B2 | | 7/2005 | Marietta | |
| 7,373,887 | B2 | * | 5/2008 | Jackson | 102/517 |
| 7,966,937 | B1 | * | 6/2011 | Jackson | 102/517 |
| 2002/0050534 | A1 | | 5/2002 | Woodall et al. | |
| 2003/0010185 | A1 | | 1/2003 | O'Dewyer | |
| 2003/0071077 | A1 | | 4/2003 | Panzarella | |
| 2004/0089187 | A1 | * | 5/2004 | Warnagiris et al. | 102/502 |
| 2004/0134672 | A1 | | 7/2004 | Tsao | |
| 2005/0229807 | A1 | * | 10/2005 | Brock et al. | 102/502 |

FOREIGN PATENT DOCUMENTS

| | | | |
|---|---|---|---|
| EP | 81301140 | | 4/1981 |
| FR | 2726355 | | 5/1996 |
| FR | 2726638 | | 5/1996 |
| GB | 2275323 | * | 8/1992 |
| IT | 1246278 | | 11/1994 |
| JP | 58062108 | | 4/1983 |
| JP | 60018181 | | 1/1985 |
| PL | 94623 | | 8/1977 |
| WO | WO 9212763 | | 8/1992 |
| WO | WO 03104743 | | 12/2003 |

OTHER PUBLICATIONS

Graham et al.; "Treatment Fluids to Improve Sea Water Injection"; New Technologies for the Exploration and Exploitation of Oil and Gas Resources; 1984.

U.S. Appl. No. 12/814,435, filed Jun. 11, 2010; Stephen C. Jacobsen; office action dated Nov. 12, 2013.

U.S. Appl. No. 12/814,435, filed Jun. 11, 2010; Stephen C. Jacobsen; office action dated Sep. 11, 2013.

* cited by examiner

LIQUID MISSILE PROJECTILE FOR BEING LAUNCHED FROM A LAUNCHING DEVICE

RELATED APPLICATIONS

This application claims the benefit of U.S. Provisional Patent Application Ser. No. 61/186,307, filed Jun. 11, 2009, and entitled, "Liquid Missile Projectile for Being Launched From a Launching Device," which is incorporated by reference in its entirety herein.

FIELD OF THE INVENTION

The present invention relates to generally to weapons and weaponry, and deterrents. More particularly, the present invention relates to non-lethal projectiles capable of being launched from a launching device towards a target or target site.

BACKGROUND OF THE INVENTION AND RELATED ART

In modern warfare, and particularly in the modern war on terror, improvised explosive devices (IEDs) are becoming an increasingly large danger to soldiers and civilians. IEDs can be almost any explosive material with any type of detonating initiator. These homemade devices are designed to kill or injure by using explosives alone or in combination with toxic chemicals, biological toxins, or radiological material. IEDs can be produced in varying sizes, functions, containers, and delivery methods. IEDs are typically categorized as package type (which may be concealed or buried to form a buried mine), vehicle borne IEDs (VBIEDs), and suicide bomb IEDs, which can be contained in a vest, belt, or clothing that is modified to carry this concealed material.

Currently, when military personnel suspect an individual to be a suicide bomber, deadly force is often the only defensive option. In such cases, military forces should be prepared for and expect a detonation. Soldiers responding to such events should shoot from a protected position at as great a distance as possible. Likewise, VBIEDs are often driven into a barrier, crowd or military force and then detonated in order to create as many casualties as possible. In each of these instances, lethal force is often the sole alternative available to protect the lives of military personnel. This situation can give rise to deadly misjudgment or dangerous hesitation. Similarly, when objects are suspected to contain or conceal IEDs, the detection and disposal of package IED is often dangerous, time consuming, and expensive.

SUMMARY OF THE INVENTION

It has been recognized that it would be advantageous to develop a launching device for projecting a substantially non-lethal charge of liquid to disarm or disable a person, vehicle, and explosive device.

Briefly, and in general terms, the invention is directed to a liquid missile or projectile for being launched from a launching device toward a target site. The liquid missile includes at least a liquid and a non-rigid flight integrity component that is combined with the liquid to inhibit substantial break-up of the liquid during flight.

In one embodiment of the invention set forth above the non-rigid flight integrity component is an additive. In another embodiment of the invention the non-rigid flight integrity component is a non-rigid encapsulation.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
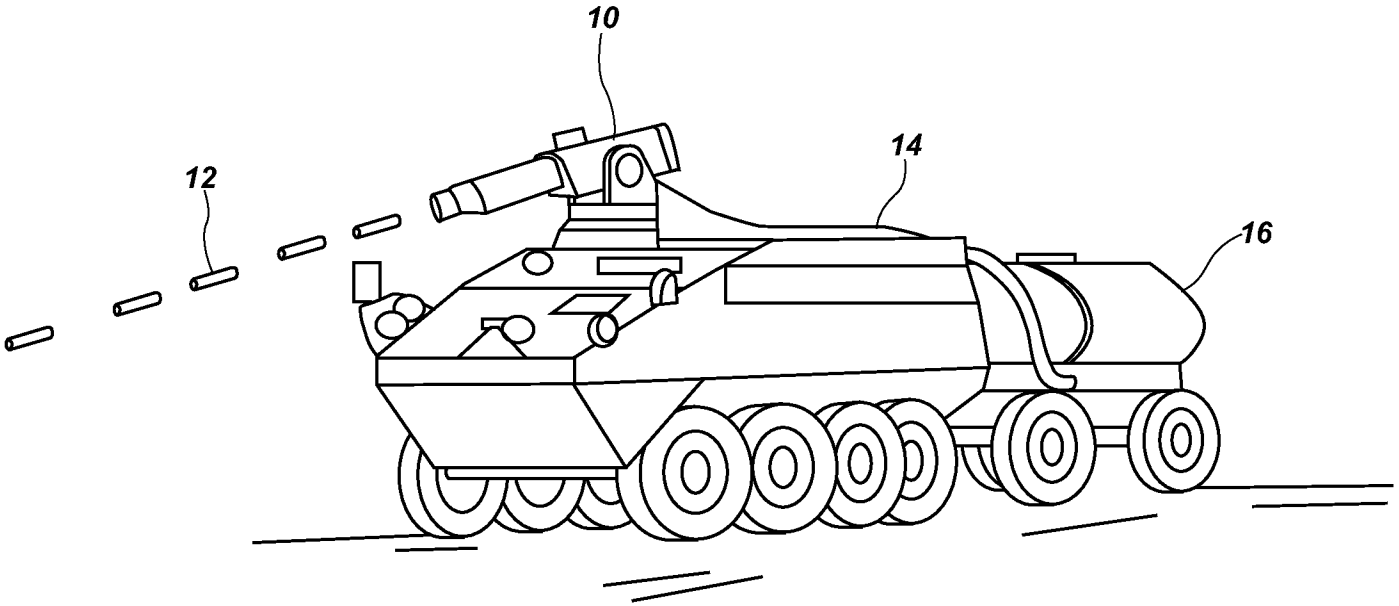
FIG. 1 is a perspective view of a liquid missile launching device in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION OF EXEMPLARY EMBODIMENTS

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments of the invention will best understood with reference to the accompanying drawings, wherein the elements and features of the embodiments are designated by numerals throughout.

In describing and claiming the present invention, the following terminology will be used.

The singular forms "a," "an," and "the" include plural referents unless the context clearly dictates otherwise. Thus, for example, reference to "a barrel" includes reference to one or more of such barrels, and reference to "an additive" includes reference to one or more of such additive.

As used herein, "flight integrity component" refers to a component that when combined with a liquid charge can inhibit substantial break-up of the liquid charge during flight.

Typically, a flight integrity component can be an additive or a non-rigid encapsulation. Combining this component with a liquid charge can substantially inhibit spray and separation of the liquid charge when launched.

As used herein, "additive" refers to any liquid, gas, or solid, that can be combined with a liquid charge to modify at least one physical property of the liquid charge.

As used herein, "liquid charge" refers to any defined quantity of any type of liquid or liquid combined with an additive, providing that the combination retains the properties of a liquid.

As used herein, "liquid missile" and "liquid projectile" refer to a liquid charge combined with a flight integrity component, which is capable of being launched from a launching device.

As used herein, "charge modification component" refers to a component that combines a liquid charge with an additive. As such, a charge modification component includes any component that has combinational capabilities for a specific additive and a specific liquid charge, or for a component that has combinational capabilities for a broad range of additives and a broad range of liquid charges.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 gallon to about 5 gallons" should be interpreted to include not only the explicitly recited values of about 1 gallon to about 5 gallons, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value and should apply regardless of the breadth of the range or the characteristics being described.

As illustrated in FIG. 1, a launching device 10 in an example implementation in accordance with the invention, is mounted on a vehicle 14, and is shown as launching or projecting a plurality of liquid missiles or projectiles 12. According to one embodiment of the invention, the launching device can be connected to a liquid source 16 having sufficient liquid and pressure means to enable the successive launch of multiple liquid missiles, as shown.

In other aspects of the invention, the liquid missile can be launched from a launching device mounted in a fixed position or on a variety of vehicles, including, but not limited to, an aircraft, a sea craft, a civilian vehicle, a ground vehicle of any kind, or a towed carriage/trailer. A liquid missile can also be launched from a portable launcher. A portable launcher can be a launching device similar to a rocket launcher or a much larger launching device. Similarly, a portable launcher for projecting a liquid missile can be a small launching device, similar to a small handheld pistol.

Because of its predominately available supply and relatively economical cost, water can serve as an effective liquid missile 12 to probe roads, streets, thoroughfares and other locations for hidden threats such as improvised explosive devices (IEDs). A liquid missile launching device 10, as illustrated in the present figure, can fire a large quantity of liquid missiles 12 in order to probe for buried or concealed mines, repulse suicide bombers, and detonate, disarm, deter or disable a threat in a substantially non-lethal fashion. When large missiles are launched, the impact of the high speed liquid missiles can disable, deter, and even overturn a vehicle.

In recent world warfare, vehicle-borne improvised explosive devices (VBIEDs) have been driven into crowds, protective barriers, traffic and military convoys in attempts to create explosive detonations causing a larger number of casualties. Often, non-VBIEDs carrying vehicles are used as decoys or barrier busters to create an entry or false threat, only to be followed by one or more VBIEDs, which comes crashing through into unsuspecting crowds or newly-exposed locations and people. A liquid missile launching device 10 capable of launching a large liquid missile 12 can deter and disable suspect vehicles, while decreasing the threat to the lives of drivers and civilians. When launched at distant targets these liquid missiles may detonate or disable explosive and other threats at a distance before the threat is in range to damage or harm its target.

A liquid missile can include a liquid charge of a specified volume (e.g., a liter). For example, liquid missiles may comprise liquid volumes ranging from 1 mL to 500 L. However, this range is not to be considered limiting as liquid missiles can comprise any volume capable of being contained and launched.

Liquid missiles 12 include at least a liquid charge combined with a non-rigid flight integrity component. The non-rigid flight integrity component can modify the liquid charge and inhibit substantial break-up of the liquid charge in flight. The flight integrity component can be an additive, a non-rigid encapsulation, a temperature modification component, or other component. Combining the flight integrity component with a liquid charge can allow the liquid charge to be launched at higher speeds and further distances than a non-modified liquid charge.

Pure water has viscous properties which allow it to reasonably maintain its form when traveling at relatively low speeds or in small quantities, such as a falling raindrop. But, when water is projected at high speeds and in large quantities, such as water projected from a fire hose, the cohesive structure of the water stream can be disrupted by air resistance, causing the resulting water stream to at least partially fracture or break apart into a spray after a certain distance. In order to launch water or other liquid charges at high speeds and far distances a flight integrity component can be combined with the water or other liquid charge to provide enhanced structure, viscosity, and/or cohesiveness. Typical liquids include: water, salt water, liquid fuel, such as flammable fuel, and other liquids.

Liquid modifying additives may also be combined with the liquid charge to inhibit substantial break-up of the liquid during flight. According to one aspect of the invention, a small quantity of polyethylene oxide (PEO), as small as 0.8% (w), can be added to a liquid, such as water, to increase the cohesive properties of the liquid. The resulting liquid missile will also have less friction and drag than the liquid alone, thus further reducing spray. When the resulting liquid missile is launched, the friction from a launching device barrel is reduced and the launched stream or missile can have greater cohesiveness, resulting in higher projection speeds, further trajectories, improved accuracy, and more effective impact with a target.

Similarly, polyacrylamide, polypropylene oxide, polydiamine, and other practical additives known in the art can also be combined with a liquid to inhibit substantial break-up of the liquid during flight. These and other additives can have other properties, aside from inhibiting break-up of a liquid charge during flight, which can be beneficial to liquid missile projectile applications. These properties may include, being slippery, being adhesive, having an odor, having a discoloration that permanently or temporarily marks a target for instant identification, or having a variety of other useful properties.

Additives can also be combined with a liquid to form shear-thickening fluids, also known as dilatant fluids, in order to inhibit substantial break-up of the liquid during flight. Shear-thickening fluids cause an increase in viscosity of the liquid charge with increasing shear stress which is most easily accomplished by increasing the rate of shear deformation. For example, a shear thickening fluid may offer little resistance to a gentle probe with one's finger, but can become increasingly viscous when one quickly thrusts a finger at the fluid. In this manner, a shear thickened liquid missile can respond to a launching force with increased resistance, enabling the liquid missile to be launched with more force. Upon impact this liquid missile can increase its resistance to the stress of the impact, thus acting more like a solid projectile and inflicting greater damage to the target.

Typical shear thickening additives can include: polyethylene glycol with nano-particles of silica, corn starch or modified corn starch, potato starch, pectin, xanthan gum, arrow root powder, dihydroxypropyl ethers of cellulose (as disclosed in U.S. Pat. No. 4,096,326), cellulose-free xanthan gum with a number of cellulose compounds, including carboxymethyl cellulose, hydroxyethyl cellulose and hydroxypropylmethyl cellulose (as disclosed in U.S. Pat. No. 4,313,765). Other examples include, sulfonated guar and a compound comprising at least one member selected from the group consisting of xanthan gum, guar, hydroxpropyl guar or derivatives, hydroxyethyl cellulose or derivatives. Further shear thickening additives may include, cationic guar and a compound comprising at least one member selected from the group of hydroxypropyl guar or derivatives and hydroxyethyl cellulose or derivatives (as disclosed in U.S. Pat. No. 4,524,003), hydroxypropyl cellulose with polymaleic and hydroxy derivatives (as disclosed in U.S. Pat. Nos. 4,169,818 and 4,172,055), or any combination as will be practical to the invention.

Additives may be combined with a liquid charge by mixing, stirring, heating/cooling processes, injecting, reacting or applying, as well as combinations of these processes. Other combining methods are similarly contemplated in accordance with the invention.

Figure 2:
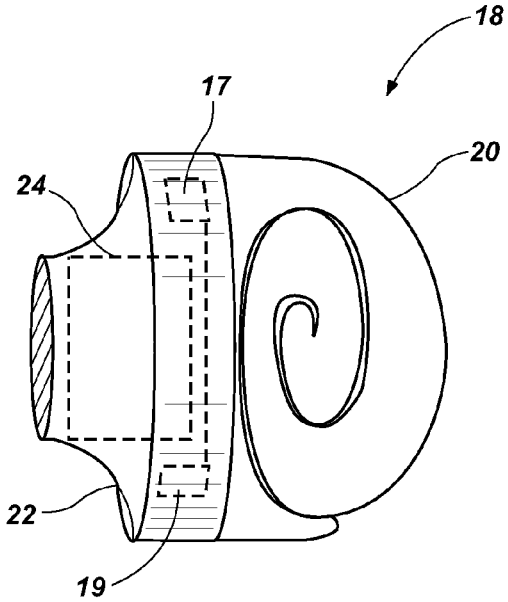
FIG. 2 is a perspective view of a non-rigid encapsulation rolled from one end onto itself in accordance with an embodiment of the present invention.

A flight integrity component (e.g., a non-rigid encapsulation or additive) filled or loaded with a liquid charge as described, combine to form a liquid missile. FIG. 2 illustrates one exemplary embodiment of a flight integrity component in the form of a non-rigid encapsulation 18 (also referred to as "encapsulation"), which can be implemented using a collapsible plastic encapsulation 20 rolled from one end onto itself, and which can be joined to a closing device 22 to seal and support the liquid charge within the encapsulation 18. When the collapsible plastic encapsulation is rolled, it is compacted to a relatively small volume to facilitate storage and loading capabilities. When a rolled encapsulation is loaded into a launching device, it can be easily unrolled in response to the pressures of the liquid charge and other substances filling the encapsulation. In other aspects of the invention, the empty plastic encapsulation can be folded, non-folded, compressed or stored in any fashion practical to the invention. The collapsible plastic encapsulation can be a non-elastic or elastic encapsulation. When elastic plastic is used the collapsible plastic encapsulation can further be left in a non-inflated, non-folded, or non-rolled position.

In another aspect of the invention, the encapsulation can be formed from a roll of flexible plastic, such as polyethylene plastic, which forms a tube. The flexible plastic can be filled with a liquid charge and sealed on a front and a rear end in order to enclose the liquid charge within the plastic. In this manner a plurality of liquid charges can be encapsulated and launched in rapid succession. The embodiments of an encapsulation and sealer device will be apparent to one of ordinary skill in the art.

The closing device 22 can be a device, such as a crimp, cap, seal, pressure seal, valve or a more complex closing device can also be used, which allows a non-rigid encapsulation to be rapidly filled with a liquid, rapidly sealed or enclosed, and launched. In another aspect of the invention, the closing device 22 and/or the non-rigid encapsulation 20 can be formed of biodegradable material. Alternatively, the closing device and non-rigid encapsulation can be integrally formed, or formed of the same piece of material.

Figure 3:
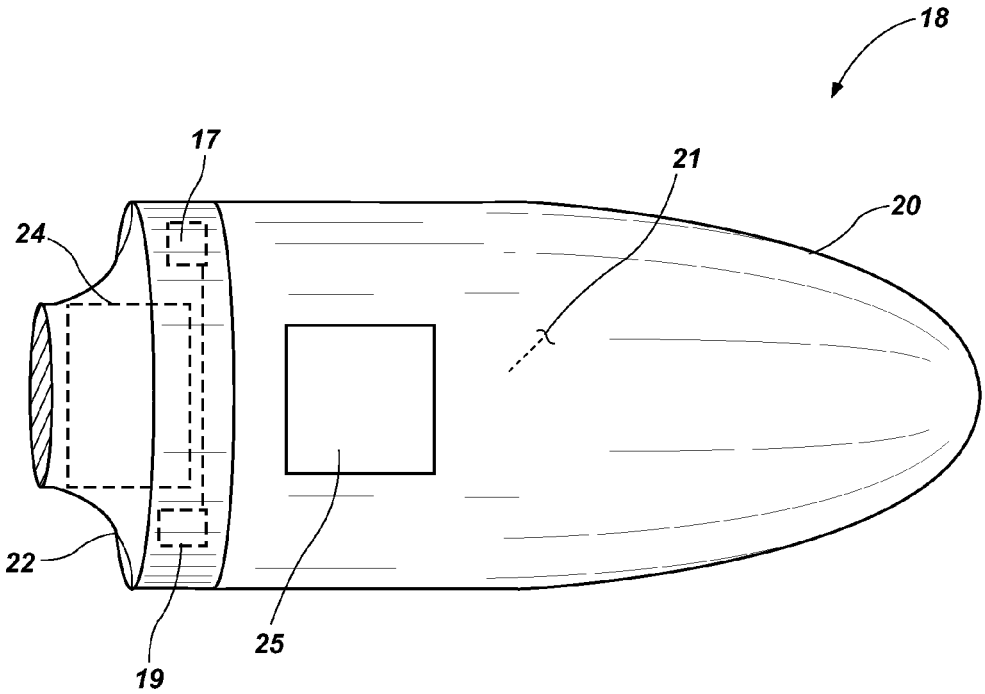
FIG. 3 is a perspective view of a non-rigid encapsulation filled with a liquid in accordance with an embodiment of the present invention.

As shown in FIG. 3, the non-rigid encapsulation 18 of FIG. 2 is filled with a liquid charge 21 to form a liquid missile or projectile capable of being launched from a launcher. The shape of the filled encapsulation can vary based on the shape of the collapsible plastic encapsulation 20, and the closing device 22. The diameter of the encapsulation can be approximately the diameter of the barrel of the launching device to enable a pressure to build up behind the encapsulation and to provide a launching force. To provide increased trajectory and accuracy, the encapsulation can have an aerodynamically designed shape. This shape may subsequently modify the shape of the closing device 22.

A propellant device 24 (see FIGS. 2 and 3) can be included in the closing device 22. The propellant device 24 can enable the liquid missile to be self propelling, or semi-self propelling. Various propellant devices can be incorporated into the closing device. These devices can be self-triggered or triggered by the launching device. A propellant device can have a variety of explosive devices, including an explosive device similar to a typical bullet, having a propellant, a primer and a casing. This explosive device can launch the liquid missile while leaving a case or shell assembly to be displaced from the launching device, or be launched with the liquid missile in a rocket-like manner. Similarly, the propellant device may launch the non-rigid encapsulation by expelling a portion of the liquid 21 contained within the encapsulation from the tail of the liquid missile. Other propellant devices and combinations thereof can be incorporated as will be practical with the invention.

In another aspect of the present invention, the non-rigid encapsulation can comprise a disruption apparatus (shown generally as disruption apparatus 25) that is configured or adapted to disrupt the flight integrity component in the form of a non-rigid encapsulation and to facilitate the dispersion of or diffuse the liquid charge. The disruption apparatus can function to breach or break up or break open the flight integrity component or encapsulation of the liquid missile or projectile, or otherwise facilitate the dispersion of the liquid charge. The disruption apparatus may be used to control the timing of the dispersion of the liquid charge (e.g., delayed or upon impact or during flight), the direction of the dispersion of the liquid charge (e.g., forward dispersion), etc. Essentially, the disruption apparatus helps to prevent the unwanted situation where the liquid missile remains intact (the liquid charge is not dispersed) after being launched, and therefore ineffective for its intended purpose.

The disruption apparatus may comprise any system or device capable of breaching or otherwise breaking open the flight integrity component of the liquid missile after being launched (i.e., the disruption apparatus can rip, tear, disassemble, explode or otherwise breach the encapsulation). The disruption apparatus may be configured to operate with the encapsulation 18 or the closing device 22, or both. The disruption apparatus may be configured to be activated during flight of the liquid missile (e.g., an airborne dispersant), or it may be activated upon or at some point after impact. The disruption apparatus may comprise mechanical, electrical, electromechanical systems. For example, the disruption apparatus can comprise an explosive device or charge supported somewhere on the liquid missile. In another example, the disruption apparatus may comprise an mechanical device that impales or otherwise breaches a portion of the liquid missile. One skilled in the art will recognize other objects or devices or systems capable of performing the function of breaching the liquid missile.

The disruption apparatus may be triggered or activated in a number of ways, and from a variety of sources, such as radio frequencies, heat sensors, timing mechanisms, laser devices, and other suitable means. For example, the disruption apparatus may be operable with a trigger of some sort. The trigger may comprise a real-time operator-initiated trigger, wherein the operator selectively triggers or activates a delayed disruption of the non-rigid encapsulation and the diffusing of the liquid charge at a time judged to be most appropriate or effective. Alternatively, the trigger may comprise a programmed trigger, such as a preprogrammed trigger that reflects actual conditions or variables to be encountered. In still another embodiment, the liquid missile may support a spool of wire (e.g., for receiving electrical signals that activate an associated disruption apparatus) or string (for activating a mechanical disruption apparatus) that is spooled upon launch of the liquid missile.

Rheologically modified fluids can also be combined with the non-rigid flight integrity component (e.g., additive, non-rigid encapsulation component) to allow for solid substances to be entrained in the liquid charge. For example, 0.10% (w) Carbopol® 674 (a product of Noveon) can be combined with a liquid charge to entrain or suspend sand particles within the liquid charge. In this manner, a variety of solids can be entrained in a liquid charge and launched. These solids can be capsules of paint, sand, pellets, explosive charges, and other solids that will be practical to the invention. In one aspect, the rheologically modified fluids can function as a flight integrity component to increase the cohesive properties of the liquid missile in flight. In another aspect, the rheologically modified fluids can provide additional mass to increase the impact force applied to the target, as well as a delivery system that transports the solids to the target.

Liquids and liquids combined with additives, as previously described, can be used to fill the non-rigid encapsulation 18. A variety of other liquids, chemicals and other substances can be combined with the liquid in the non-rigid encapsulation. These substances include, but are not limited to: a liquid for creating an oxygen depletion region in or near a target location, such as liquid carbon dioxide, liquid nitrogen, liquid oxygen, liquid methane, liquid propane, or other gases cooled to be in a liquid phase, etc., to extinguish combustion or produce vehicle and other motor stalls; tear gas or pepper spray for blinding a target; odor-producing substances for repelling a target; opaque paint for obstructing vision; visible paint or stains for marking and identifying a target; liquid adhesives or fibers, such as aramid fibers, spectra fibers, carbon fibers and metal strands, for creating a mechanical interference with machinery, such as rotating equipment and vehicles; foaming agents to fill a volume of space with foam, to obstruct vision, to immobilize vehicles, and to act as a road friction modifier or all surface surfactant; friction reduction agents for creating a slippery environment; an entrainment of long fibers or ribbons to entangle and entrap personnel and machinery; and a variety of other gasses, liquids, and endothermic and/or exothermic substances, additives, and liquids can be used as will be practical to the invention.

In another aspect of the invention the modified fluid can comprise an electro-rheological fluid or a magneto-rheological fluid, in which the fluid properties can be modified in a controlled manner by the application of an electrical charge or magnetic field to the fluid. The electrical charge or magnetic field can be provided by electronic hardware 19 (see FIGS. 2 and 3) coupled to or operable with an energy source 17 (see FIGS. 2 and 3) included with the non-rigid encapsulation, such as the closing device 22, and which can be configured to provide the electrical charge or magnetic field before, during and after launch to create and maintain the non-rigid encapsulation for the launch and duration of the flight. The electronic hardware can also be configured to discontinue the electrical charge or magnetic field at the appropriate time to disrupt the non-rigid encapsulation and release the liquid charge.

Figure 4:
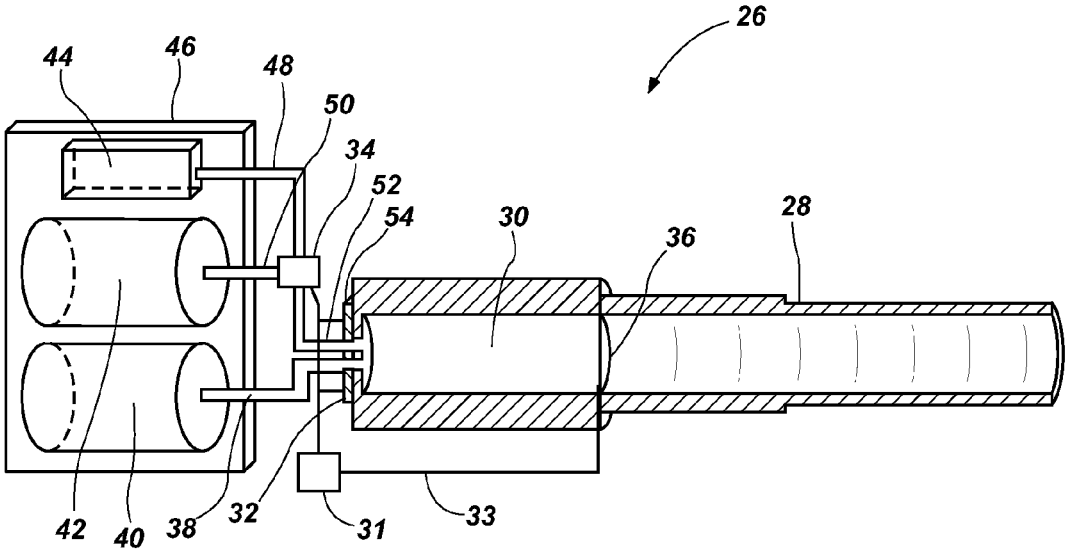
FIG. 4 is a cross-sectional view of a liquid missile launching device in accordance with an embodiment of the present invention.

A representative implementation of the invention can include a launching device 26, as shown in FIG. 4. The launching device 26 can include a barrel 28, a chamber 30, a launching system (comprising the pressurized gas source 40, launching valve 32, and gas connection line 38), and a charge modification component 34. The barrel can be joined to the chamber at one end, and can direct a liquid missile in a direct path down and out the opposite end. A liquid missile can be formed in the chamber. The chamber can also include a liquid inlet 54 valve, a launching valve 32, and a chamber release valve 36. The modified liquid can enter the chamber from the liquid inlet, and is enclosed by the closure release mechanism 36. When the chamber is filled with the modified liquid, forming a liquid missile, the liquid inlet valve 54 is closed and the launching valve 32 is opened. The launching valve can release the pressurized gas into the chamber, via a gas connection line, increasing the pressure behind the liquid missile. As the launching valve opens the chamber release valve 36 can also be opened, allowing the pressurized gas to launch the liquid charge down and out the barrel. The valves can be selected from a variety of control and release valves practical to the invention, including ball, globe, gate, butterfly and rupture valves, etc.

The modified liquid can enter the chamber from a charge modification component 34, which combines a liquid from a liquid source 42, and a flight integrity component from a flight integrity component source 44. The charge modification component can receive the flight integrity component via a flight integrity component source connection 48. The charge modification component prepares the liquid to resist substantial break-up during launch. The charge modification component can be a relatively simple device that mixes a liquid with a predefined proportion of an additive or it can be a multi-process device that also modifies temperatures and/or pressure, adds reactants, or any combination of these functions. The modified liquid is directed to the inlet valve via a modified liquid connection line 52.

A sighting structure can be coupled to the barrel for identifying and targeting a target location. The sighting structure employed in the present invention includes a wide variety of sighting structures. Typical sighting structures can include a laser sight, an infra-red targeting system, optic sights, dot sights, ring sights, peep sights, a scope, and the like. Alternatively, a sighting structure can include a camera, or an electronic or electromechanical device that provides targeting capabilities to a user, or any combination of sighting structures. For example, a pilot flying a helicopter or plane which is configured with a launching device, according to the present invention, can have a targeting panel which allows him to target the location via an electrical panel or an electromechanical apparatus. In this manner the sighting structure is coupled to the barrel via electronic sensors, controllers, or the like.

A controller 31 or combination of multiple controllers may be incorporated into the launching device 26 to act as a sequencer by controlling and synchronizing the function of the launching valve 32, the chamber release valve 36, and the inlet valve 54. By controlling the charge modification component 34, the chamber release valve, and the inlet valve, a controller can act as a loader. A controller implementation can be a mechanical or electric controller for sequentially opening and closing valves, as shown by electrical wire connections 33.

Figure 5:
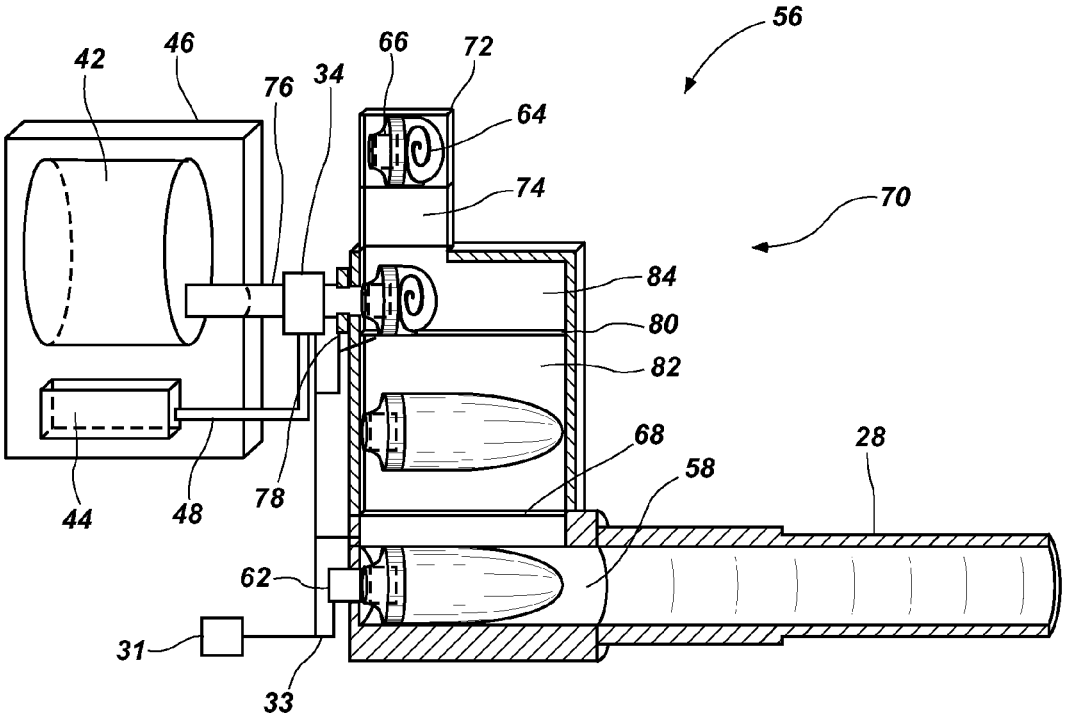
FIG. 5 is a cross-sectional view of another liquid missile launching device in accordance with another embodiment of the present invention.

In one aspect of the invention, the flight integrity component source 44, liquid source 42, and the gas source 40, can be contained or carried in a source transport system 46 (see source transport system 46 in FIGS. 4 and 5). This transport system may be a backpack device, a trailer apparatus (as shown in FIG. 1), or other transport systems that will be practical to the invention. The liquid source can be an open salt water source or fresh water source, a fire hydrant, a tank of pressurized or non-pressurized liquid, or another liquid source that will be practical with the invention.

As shown in FIG. 5, another representative implementation of the invention can comprise a launching device 56 including a barrel 28, a launching chamber 58, and a launching system having a triggering device 62 and a propulsion device 66 operable with a liquid missile. The launching device can also include a charge modification component 34 which includes a charge modification chamber 84, an inlet valve 78, a charge modification component chamber enclosure 80, and an encapsulation loader 74, as well as a loader 68 and a sequencer 70.

The launching device 56 can modify a liquid charge by enclosing the liquid in a non-rigid encapsulation 64, forming a liquid missile, the function of which was previously described. The non-rigid encapsulation can have a collapsible plastic encapsulation capable of being rolled from one end onto itself to comprise an unfilled configuration. The encapsulation loader, being configured to relocate an encapsulation from the encapsulation source to the charge modification device, loads an empty encapsulation from the encapsulation source 72 into the charge modification device, where it is filled with a liquid or liquid charge. This loading process can be accomplished by means of a moving wall, which allows the encapsulation to fall into place by gravity, or other methods that will be practical to the invention.

The non-rigid encapsulation 64 can be filled with liquid from a liquid source 42 loaded via a liquid connection line 76 and an inlet valve 78, and which liquid connection line 76 may or may not include a charge modification component 34. As liquid enters the non-rigid encapsulation the collapsible plastic encapsulation can begin to un-pack, unroll, unfold, or decompress as it expands in response to the pressure of the liquid. The charge modification chamber 84 can be configured to suit the particular encapsulation expanding method or plurality of methods. When the encapsulation is filled with liquid the inlet valve can be closed and a closing device 22 (as previously described) is fixed or secured to enclose the liquid inside the collapsible plastic encapsulation. The filled encapsulation can now form a liquid missile and can be moved to the loading chamber 82. The loading chamber can be configured to hold multiple filled encapsulations or it can be configured to hold a single, filled encapsulation. The loading chamber can be an enclosed structure, with an opening for a loader, or a chamber, combined with a breech for alternative back loading. Once the liquid missile is in the loading chamber, the loader 68 can load it into the launching chamber 58. The loader can be a simple movable wall for mechanically positioning the liquid missile in position for launching within the launching chamber, or a more complex loading mechanism, as will be practical to the invention.

In another aspect of the invention, a filled encapsulation can be transferred directly from the charge modification chamber 84 into the launching chamber. The charge modification chamber can also be incorporated into the launching chamber, so as to eliminate transportation of the filled encapsulation. The incorporation of these two components will be apparent to one of ordinary skill in the art.

Once a liquid missile has been loaded into the launching chamber and the chamber is closed, the triggering device 62 can trigger the propellant device 66 of the non-rigid encapsulation, launching the liquid missile down the barrel 28. The propellant device can incorporate a variety of devices as will be practical to the invention, as previously described. Such a propellant device can be integrally joined to the non-rigid encapsulation, or can become disengaged upon ignition of the propellant device. Alternatively, the triggering device can trigger a separate explosive device within the launching chamber that will launch the liquid missile down and out the barrel.

The encapsulation source 72, encapsulation loader 74, charge modification component 34 and loading chamber 82 can combine to form a sequencer 70. The sequencer can enable sequential launching of a plurality of liquid missiles to cause these to mix at the target site, whereupon mixing a functional attribute is obtained. Liquid missiles may be fed into the loader 68 and subsequently loaded into the launching chamber 58. In this manner, a plurality of liquid missiles can be fired in succession, as illustrated in FIG. 1. However, launching the liquid missiles in succession may not always be desirable. It is contemplated that a plurality of liquid missiles that are intended to mix at the target site may be launched from different launching devices, wherein strategic timing and placement of the various liquid missiles may be of concern and therefore specifically controlled.

In one aspect of the invention, a controller 31 or combination of multiple controllers can be incorporated into the launching device 56 to aid the sequencer by controlling and synchronizing the various components of the sequencer. A controller implementation can be a mechanical or an electric controller for sequentially opening and closing valves, as shown by electrical wire connections 33.

In another aspect of the invention, the charge of liquid received from liquid source 42 may be combined in the charge modification component 34 with a flight integrity component from flight integrity component source 44, as previously described, before the liquid is inserted into the non-rigid encapsulation 62. The flight integrity component is connected to the charge modification component via a flight integrity component source connection 48. The flight integrity component may be a variety of additives, liquids, chemicals and other substances that can be inserted into a non-rigid encapsulation, as previously described. For example, a liquid for creating an oxygen depletion region can be added into a liquid and loaded into a non-rigid encapsulation, for launch.

Furthermore, the charge modification component 34 can be fluidly coupled to multiple liquid sources 42 and multiple flight integrity component sources 44, to provide a plurality of liquid missiles that include two or more different types of fluids and/or entrained solids, and which can be sequenced and launched so that the two or more liquids, with/or without entrained solids, mix and react at the impact site to accomplish a desired effect that would not be possible or practical with a single component by itself.

Figure 6:
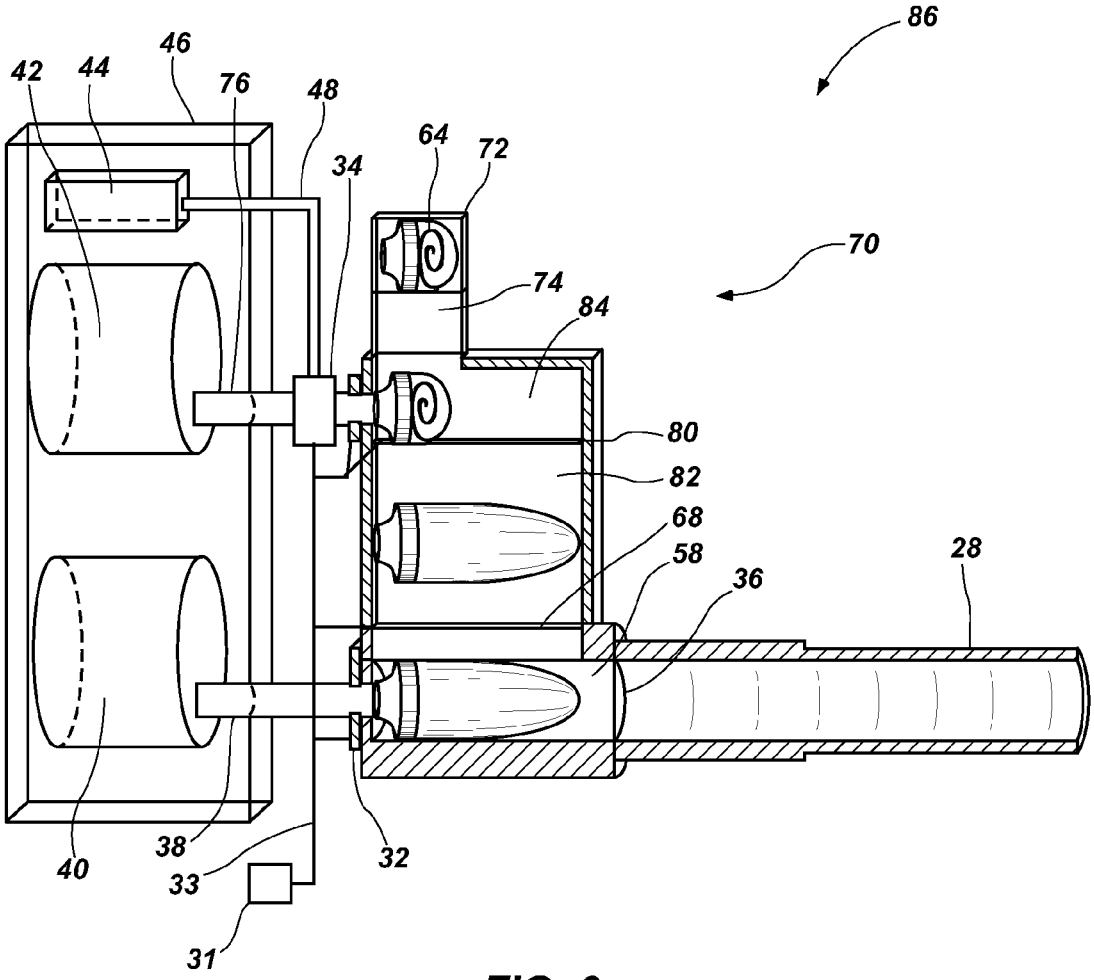
FIG. 6 is a cross-sectional view of another liquid missile launching device in accordance with yet another embodiment of the present invention.

As shown in FIG. 6, a launching device 86 according to one aspect of the invention is similar in parts and function to the launching device 56 of FIG. 5, except that it contains a launching system that uses pressurized gas (comprising a gas source 40, a gas source connecting line 38, and a launching valve 32) similar to that of FIG. 4. The description above relating to FIGS. 4 and 5 is incorporated herein where appropriate. Once a liquid missile or filled encapsulation is positioned inside the launching chamber 58 of the launching device, the launching valve can be opened, pressurizing the area behind the liquid missile and forcing the liquid missile down and out the barrel 38. As illustrated, a chamber release valve 36 can be incorporated with the launching chamber to allow for an increase in pressure build-up before launch.

In another aspect of the present invention the launching device can include multiple dual-purpose charge modification/launching chambers arranged in a circular pattern or cartridge that is rotatable about a central axis offset from the longitudinal axis of the barrel 28. As can be appreciated, sequentially rotating the dual-purpose chambers into alignment with the barrel 28 of the launching device can allow for the sequential launching of multiple liquid missiles, much like a Gatling Gun. The rotating cartridge can further be configured as a rotating sequencer, complete with an encapsulation source, an encapsulation loader, and a charge modification component, that can fill and prepare an encapsulation in each dual purpose chamber for launching as the cartridge rotates the chamber towards the barrel of the launching device. Once the dual-purpose chamber is aligned with the barrel, the launching device can use either the explosive propellant device 66 of FIG. 5 or the compress gas source 40 of FIG. 6 to launch the liquid missile.

It is also contemplated that the non-rigid encapsulation used in each of the above described launching devices can be pre-filled and a liquid missile pre-formed and subsequently loaded into the launching device.

Figure 7:
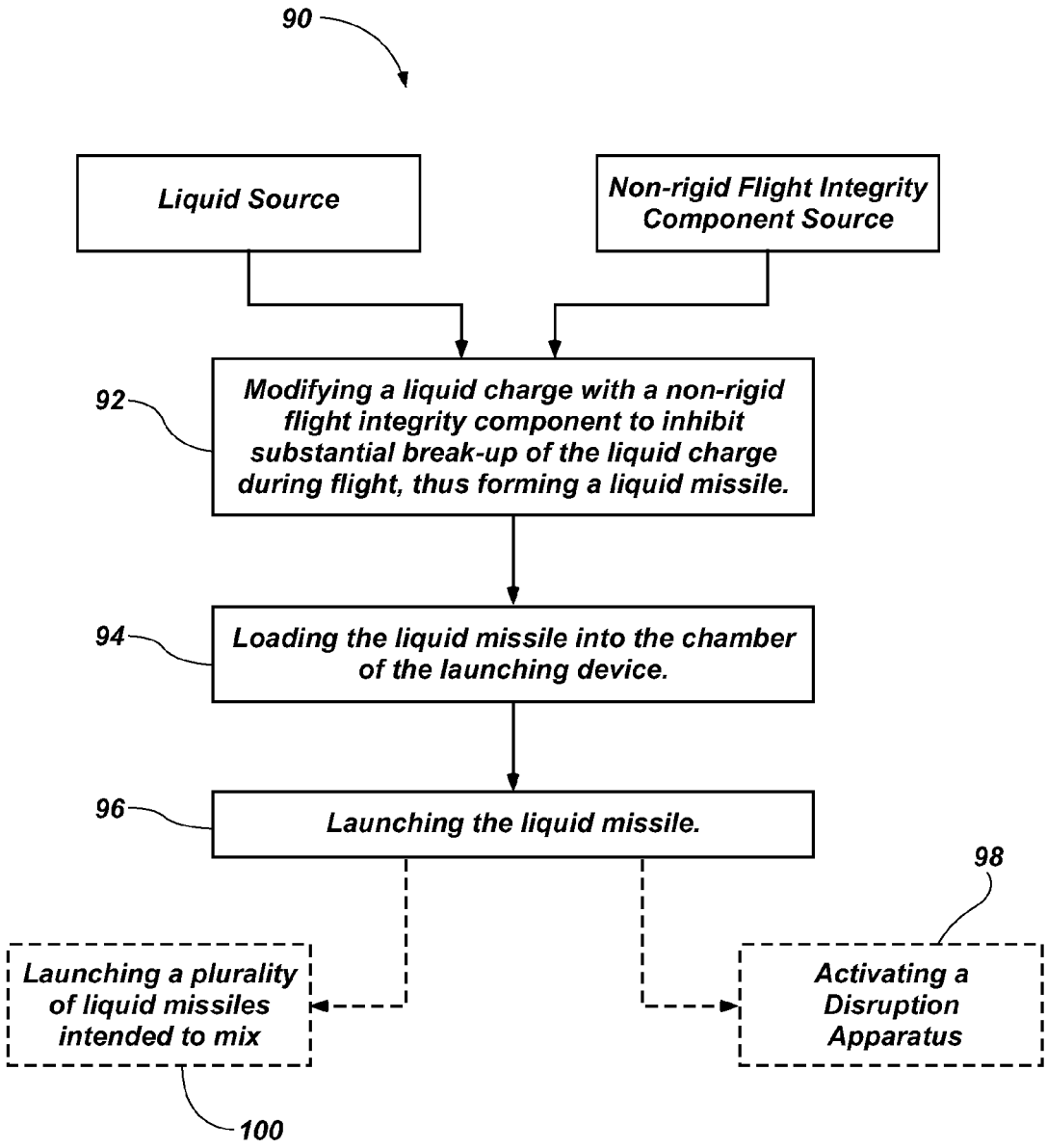
FIG. 7 is a flow chart of a method of utilizing a liquid missile in a liquid projecting device in accordance with an embodiment of the present invention.

Illustrated in FIG. 7 is a method 90 for utilizing a liquid charge in a liquid missile launching device, in accordance with a representative embodiment of the present invention. The method 90 includes modifying 92 a charge of liquid from a liquid source with a non-rigid flight integrity component to inhibit substantial break-up of the liquid charge during flight, and forming a liquid missile. The non-rigid flight integrity component can comprise a variety of components, as previously mentioned. In one aspect the flight integrity component is an additive, and modifying 92 can comprise mixing the liquid charge with the additive to increase the viscosity and/or cohesiveness of the liquid charge in response to shear forces, and/or to reduce the friction and drag of the liquid charge. In another aspect the flight integrity component is a non-rigid encapsulation, such as a collapsible plastic encapsulation, and modifying 92 includes encapsulating the liquid charge within the encapsulation.

The method 90 also includes loading 94 the liquid missile into a chamber. In cases where the flight integrity component is a non-rigid encapsulation, loading 94 further comprises loading the filled encapsulation into the chamber. In cases where the flight integrity component is an additive, loading 94 further comprises loading the liquid/additive mixture into the chamber. The method 90 further includes launching 96 the liquid missile from the liquid missile launching device. Launching 96 can include discharging the liquid missile from the chamber with pressurized gas, or with an explosive device. This step can also comprise triggering a launch. When triggering a launch, the liquid missile launching device can trigger the launch of the liquid missile, wherein the liquid missile itself includes the propellant device to propel the liquid missile from the launching device.

The method 90 may, optionally, further comprise activating 98 a disruption apparatus to effectively breach the liquid missile to facilitate the dispersion of the liquid charge once launched.

In yet another aspect of the present invention, the method for utilizing a liquid charge in a liquid missile launching device can further comprise launching 100 a plurality of liquid missiles at a target site to effectuate useful mixing of the contents present in the individual liquid missiles. The idea behind sequential launching is that at least two of the plurality of sequentially launched liquid missiles can be comprised of contents that, when unmixed, are relatively inert, but that when mixed together possess a functional attribute. Functional attributes may include exploding, corroding, freezing, fouling with fibers or high viscosity fluid, creating an oxygen-depletion zone, creating a cloud that reduces visibility, etc. The step of sequencing comprises organizing the modifying 92, loading 94, and launching 96 steps, and repeating the steps in the desired sequence to sequentially launch the plurality of liquid missiles.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed and desired to be secured by Letters Patent is:

1. A liquid missile for projection from a launching device against a target, comprising:

a liquid charge for being projected from the launching device; and a non-rigid flight integrity component comprising an additive combined with the liquid charge to inhibit substantial break-up of the liquid charge during flight, wherein the liquid charge and the non-rigid flight integrity component form a liquid missile that remains substantially intact during flight, and that fluidly disperses upon impact.

2. The liquid missile of claim 1, wherein the additive includes a cohesiveness-increasing component that increases liquid cohesiveness.

3. The liquid missile of claim 2, wherein the cohesiveness-increasing component is selected from the group consisting of polyethylene oxide, polyacrylamide, polypropylene oxide, polydiamine, and combinations or mixtures thereof.

4. The liquid missile of claim 1, wherein the additive includes a viscosity-increasing component that increases the viscosity of the liquid charge in response to shear force.

5. The liquid missile of claim 1, wherein the additive is selected from a group consisting of: polyethylene glycol with nano particles of silica; corn starch; potato starch; pectin; xanthan gum; arrow root powder; dihydroxyproprl ethers of cellulose; cellulose-free xanthan gum with a number of cellulose compounds, including carboxymethyl cellulose, hydroxyethyl cellulose, and hydroxypropylmethyl; sulfonated guar and hydropropyl guar or derivatives; sulfonated guar and hydroxyelthyl cellulose or derivatives; cationic guar and hydroxypropyl guar or derivatives; cationic guar and hydroxyelthyl cellulose or derivatives; hydroxylpropyl cellulose with polymaleic and hydroxyl derivatives; and polyethylene oxide; or combinations or mixtures thereof.

6. The liquid missile of claim 1, wherein the additive comprises a shear-thickening component adapted to increase the viscosity of the liquid charge with increasing shear stress applied thereto.

7. The liquid missile of claim 1, wherein the additive comprises a rheologically modified fluid.

8. The liquid missile of claim 1, wherein the additive comprises an electro-rheological fluid.

9. The liquid missile of claim 1, wherein the additive comprises a magneto-rheological fluid.

10. The liquid missile of claim 1, wherein the liquid charge comprises a rheologically modified fluid.

11. The liquid missile of claim 1, wherein the liquid charge comprises an electro-rheological fluid.

12. The liquid missile of claim 1, wherein the liquid charge comprises a magneto-rheological fluid.

13. The liquid missile of claim 1, wherein the liquid charge provides an oxygen depletion region in or near a target location.

14. The liquid missile of claim 1, wherein the liquid charge is selected from a group consisting of liquid carbon dioxide, liquid nitrogen, liquid oxygen, liquid methane and liquid propane.

15. The liquid missile of claim 1, wherein the liquid charge contains entrained solids for delivering the entrained solids against the target.

16. A method for utilizing a liquid missile in a liquid missile launching device, the method comprising:

modifying a liquid charge with a non-rigid flight integrity component comprising an additive to inhibit substantial break-up of the liquid charge during flight to form a liquid missile, wherein the liquid charge and the non-rigid flight integrity component form a substantially non-rigid missile that remains substantially intact during flight, and that fluidly disperses upon impact;

loading the liquid missile having the flight integrity component into a chamber; and launching the liquid missile from the liquid missile launching device.

17. The method of claim 16, wherein modifying the liquid charge comprises mixing the liquid charge with a cohesiveness-increasing additive to increases the cohesiveness of the liquid missile.

18. The method of claim 16, wherein modifying the liquid charge comprises mixing the liquid charge with a viscosity-increasing additive to increases the viscosity of the liquid missile.

19. The method of claim 16, further comprising launching a plurality of liquid missiles in a sequence to effectuate useful mixing of contents of individual liquid missiles at a target site, wherein at least two of the plurality of sequentially launched liquid missiles are comprised of contents that, when unmixed, are relatively inert, but that when mixed together possess a functional attribute.

* * * * *